United States Patent [19]

Oka et al.

[11] 4,360,422

[45] Nov. 23, 1982

[54] PROCESS FOR SELECTIVELY AGGREGATING COAL POWDER

[75] Inventors: Naoki Oka; Nobuo Tanaka; Takashi Ando, all of Chiba, Japan

[73] Assignee: Idemitsu Kosan Co., Ltd., Tokyo, Japan

[21] Appl. No.: 292,850

[22] Filed: Aug. 14, 1981

[30] Foreign Application Priority Data

Aug. 18, 1980 [JP] Japan ..... 55/112658

[51] Int. Cl.[3] ..... B03B 1/00

[52] U.S. Cl. ..... 209/5; 44/1 SR; 44/24

[58] Field of Search ..... 44/1 A, 1 B, 1 C, 1 SR, 44/24; 209/5, 2, 10, 11, 49

[56] References Cited

U.S. PATENT DOCUMENTS 4,261,699 4/1981 Sun et al. ..... 44/24

FOREIGN PATENT DOCUMENTS 2023172 12/1979 United Kingdom ..... 44/1 R

*Primary Examiner*—Bernard Nozick

*Attorney, Agent, or Firm*—Sughrue, Mion, Zinn, Macpeak & Seas

[57] ABSTRACT

A process for removing ash from raw coal is described, comprising adding mineral oil to a slurry composed of a coal powder and water, granulating the coal by stirring to form granules, and separating the resulting coal granules by a screen, wherein the improvement comprises granulating the coal using a mineral oil mixture consisting of from 0.1 to 10% by weight of a heavy fraction having a boiling point of at least 330° C. and from 90 to 99.9% by weight of a light fraction having a boiling point of 230° C. or less, heating the coal granules separated by the screen to evaporate and recover almost all of the light fraction, and reusing the recovered light fraction for granulation of additional coal granules.

5 Claims, No Drawings

PROCESS FOR SELECTIVELY AGGREGATING COAL POWDER

FIELD OF THE INVENTION

The present invention relates to a process for selectively aggregating a coal powder.

BACKGROUND OF THE INVENTION

Hitherto, for the purpose of removing ash from ash-rich coal, it has been known to use a process comprising stirring powdered coal together with a heavy hydrocarbon oil in the presence of water to form an oil containing aggregate of coal. However, this process has the deficiency that the cost of treatment is higher than in the case of using other processes, because about 20% by weight (based on the weight of the coal) of hydrocarbon oil is generally required. In order to overcome this deficiency, it has been proposed to use a process which comprises producing a coal-oil aggregate from a coal powder from which a fine powder part has been removed, and a process which comprises additionally adding a coal powder to the formed coal-oil aggregate. However, according to these processes, it is not possible to obtain a coal-oil aggregate having a desirably low oil content and having a satisfactory strength.

Another known process comprises stirring coal powder together with a light hydrocarbon oil in the presence of water to granulate the coal and separating the resulting coal granules and ash by means of a screen has been known. In this case, the process has the advantage that the light hydrocarbon oil can be reused by evaporating and then condensing it, but there is a deficiency in that the resulting coal granules are easily repowdered due to low strength.

SUMMARY OF THE INVENTION

As a result of studies for the purpose of overcoming the above described deficiencies of the prior processes, a process has now been found by which the amount of the hydrocarbon oil required for forming a coal-oil aggregate is reduced, and coal granules having a high strength can be obtained.

Namely, an object of the present invention is to provide a process for selectively aggregating coal particles in order to remove ash by which a coal-oil aggregate (granules) having a high strength can be obtained using a relatively small amount of hydrocarbon oil.

According to the present invention, the above described object can be attained by a process for removing ash from raw coal comprising adding mineral oil to a slurry composed of a coal powder and water, granulating the coal component into granules by stirring, and separating the resulting coal granules by a screen, wherein the improvement comprises granulating the coal using a mineral oil mixture consisting of from 0.1 to 10% by weight of a heavy fraction having a boiling point of at least 330° C. and from 90 to 99.9% by weight of a light fraction having a boiling point of 230° C. or less, heating the coal granules separated by the screen to evaporate and recover almost all of the light fraction, and reusing the recovered light fraction for granulation of additional coal power.

DETAILED DESCRIPTION OF THE INVENTION

The process of the present invention is illustrated by reference to an example thereof below.

First, a coal power powdered to about 60 mesh size is finely powdered by a ball mill (i.e., so as to pass through a 200 mesh screen). Powdering by the ball mill is carried out in a presence of water, by which separation of ash in the raw coal can be improved. To the resulting coal slurry, having a coal concentration of from 2 to 40%, a mixture consisting of a light fraction having a boiling point of 230° C. or less and a heavy fraction having a boiling point of 330° C. or more is added in an amount of from 10 to 30% by weight, based on the weight of the coal, and the slurry is then mixed by stirring by means of a conventional stirring apparatus, to granulate the coal powder. The resulting granules are subjected to filtration with using a 60 mesh screen to separate coal-oil granules from ash and water. The separated coal-oil granules are subjected to stripping (evaporation of solvent) using a heated inert gas, for example, heated steam having a temperature of 107° C., to recover almost all of the light fraction from the granules. The recovered light fraction is then reused for granulating a further portion of coal slurry. The coal granules aggregated by the heavy fraction from which almost all of the light fraction was stripped off are recovered as a product. On the other hand, the ash and water separated by filtration are processed by a thickener (apparatus) to further divide the mixture into ash and water. The ash is dumped in a prescribed area and the water separated is reused for powdering the raw coal powder by the ball mill.

The raw coal used in the present invention is not particularly limited to a certain kind, and it is possible to process not only superior coal having a low ash content, but also inferior coal having a high ash or water content, in the same manner. The powdery raw material of such raw coal may have any particle size, but it is generally preferred to have a particle size in the range of 60 mesh or so. It is particularly preferred that the fine powdering of the powdery raw coal be carried out in the presence of water, because separation of ash is thereby accelerated.

In the present invention, as the light mineral oil fraction having a boiling point of 230° C. or less used for formation of the coal-oil aggregate, there are, for example, light naphtha, heavy naphtha, kerosine, straight-run gasoline, benzene, toluene, xylene, and cyclohexane. As the heavy mineral oil fraction having a boiling point of at least 330° C., there are, for example, vacuum gas oil, vacuum residue, atmospheric residuum, deasphalted oil, asphalt, and coal tar.

In the present invention, the reason why the fraction distilled at a temperature of 230° C. or less is used as a light fraction is that an amount of steam consumption during stripping is small, and economization of mineral oil consumption can be easily attained. On the other hand, the reason why the fraction distilled at a temperature of 330° C. or more is used as a heavy fraction is that the fraction is not removed during steam stripping and a sufficient cohesive strength cannot be imported to the coal powder if a fraction distilled at a temperature lower than the above described temperature is used.

Further, concerning the mixing ratio of the light fraction and the heavy fraction, the heavy fraction is from 0.1 to 10% by weight. If the mixing ratio of the heavy fraction is less than 0.1% by weight, the strength of the coal granules can not be sufficiently increased. If it exceeds 10% by weight, the mineral oil consumption necessary to produce coal granules increases and, consequently, the process is not economical.

Although there is no upper limit concerning an amount of the mineral oil added to the coal slurry, an amount of from 10 to 30% by weight based on the raw coal powder is preferred in the viewpoint of economization and fluidity of the resulted coal-oil aggregate granules.

Various modification may be made in the process for separating and recovering the light oil from the formed coal granules, and it is possible to use various processes, for example, a process which comprises merely heating and a process which comprises stripping by a heated inert gas. As the inert gas, there are nitrogen, carbon dioxide gas and steam, etc. and steam is preferable.

According to the process of the present invention, since the light mineral oil fraction used for forming coal granules is recovered and reused, almost all of the mineral oil left in the resulting coal granules is a heavy mineral oil fraction. Consequently, not only is the consumption of the mineral oil reduced, but also a good product having an excellent mechanical strength can be obtained because of a high adhesive strength of the heavy mineral oil fraction to the coal powder.

Accordingly, the process of the present invention is suitable for removing the ash and water in various grades of coal, by which coal granules which are easy to handle at transportation or processing can be produced in large quantities at a low cost.

In the following, the present invention is illustrated in greater detail by reference to examples.

EXAMPLES 1–5

Coal having a composition consisting of water 2.9%, volatile matter 24.2%, ash 7.2% and fixed carbon 65.7% was used. 1 kg of a powder of the coal (average particle size: 60 mesh) was mixed with 0.4 kg of water and was powdered for 5 minutes by a ball mill to produce a coal slurry. To the resulting coal slurry, water in an amount making the total 50 liters, and 0.2 kg of light naphtha (boiling point: 65° C.–120° C.) containing 0.1, 0.3, 0.5, 1.0, and 2.0% by weight of deasphalting asphalt, respectively, as the heavy mineral oil fraction, were added, and the resulting mixtures were stirred for 30 minutes by a stirrer (Labostirrer LR-41, produced by Yamato Scientific Co., Ltd.) at 500 rpm. The resulting coal granules were separated by filtration and the separated coal granules were subjected to steam stripping by passing 0.13 kg of superheated steam at 107° C. They were cooled by a cooler to condensate water which was then removed to recover naphtha as a light mineral oil fraction. The resulting naphtha was reused for production of coal granules.

The resulting coal granules were shaken for 5 minutes at 70 V by means of a oscillation screener (automatic oscillation screener RSA - 1, produced by Takabayashi Rika Co., Ltd.), and the weight of the coal granules left on a 60 mesh screen was measured to determine the strength of the granules.

COMPARATIVE EXAMPLES 1–2

Coal granules were produced by the same procedure as in the above described Examples 1–5, except that light cycle gas oil (initial boiling point: 207° C., final boiling point: 301° C., amount of distillate up to 230° C.: 10%) which is distillate of Fluid Catalytic Cracking Unit was used alone as a mineral oil in amounts of 20% and 30%, respectively.

COMPARATIVE EXAMPLE 3

Coal granules were produced by the same procedure as in the above described Examples 1 to 5, except that light naphtha (having the same properties as in Examples 1 to 5) which did not contain deasphalting asphalt was used alone as the mineral oil.

Results obtained in the Examples and Comparative Examples are shown in Table 1.

COMPARATIVE EXAMPLES 1–2

The same procedure as in the above described Examples 1 to 5 was carried out except that atmospheric distillation residual oil from Kuwait crude oil was used alone as a mineral oil in amounts of 35% and 20%, respectively. Results are shown in Table 1.

TABLE 1

| Example | Content of deasphalting asphalt (% by weight) | Amount of mineral oil added (%) | Coal recovery ratio*2 (%) | Coal Granule Ash (% by weight) | Coal Granule Oil (% by weight) | Coal Granule Strength (%) | Lower limit of mineral oil added*1 (% by weight) |
|---|---|---|---|---|---|---|---|
| 1 | 0.1 | 20 | 85.9 | 5.0 | 0.1 | 79 | 15 |
| 2 | 0.3 | 20 | 86.9 | 5.0 | 0.3 | 87 | 15 |
| 3 | 0.5 | 20 | 87.4 | 5.2 | 0.5 | 97 | 15 |
| 4 | 1.0 | 20 | 87.3 | 5.3 | 1.0 | 97 | 15 |
| 5 | 2.0 | 20 | 93.5 | 5.3 | 2.0 | 98 | 15 |
| Comparative Example 1 | — | 20 | 45.0 | 6.2 | 20 | 88 | — |
| Comparative Example 2 | — | 30 | 50.0 | 5.5 | 23 | 89 | — |
| Comparative Example 3 | — | 20 | 85.1 | 5.1 | trace | 0 | — |
| Reference Example 1 | — | 35 | 50 | 6.3 | 35 | 92 | — |
| Reference Example 2 | — | 20 | Coal granules could not be obtained. | | | | |

*1Minimum amount of mineral oil necessary to obtain a coal recovery ratio of 85% or more.

$$*^2\text{Coal recovery ratio} = \frac{\text{Weight of coal granules}\left(1 - \frac{\text{Ash in coal granules}}{}\right)}{\text{Weight of coal }(1 - \text{Ash})} \times 100\ (\%)$$

It is understood from the results shown in Table 1 that products having a sufficiently high strength can be obtained in the case of the process of the present invention, even if a residual oil content in the coal granules is very low, i.e., even if the amount of mineral oil used is reduced, as compared with the prior cases of producing coal granules using the heavy oil alone.

Further, it is understood that coal granules having a remarkably high strength and excellent quality can be obtained by increasing only slightly the residual oil content in the coal granules, as compared with the cases of producing coal granules using light oil alone.

What is claimed is:

1. A process for removing ash from raw coal comprising adding mineral oil to a slurry composed of a coal powder and water, granulating the coal by stirring to form granules, and separating the resulting coal granules by a screen, wherein the improvement comprises granulating the coal using a mineral oil mixture consisting from 0.1 to 10% by weight of a heavy fraction having a boiling point of at least 330° C. and from 90 to 99.9% by weight of a light fraction having a boiling point of 230° C. or less, heating the coal granules separated by the screen to evaporate and recover almost all of the light fraction, and reusing the recovered light fraction for granulation of additional coal granules.

2. A process as in claim 1, wherein the mineral oil mixture is added to the slurry composed of a coal powder and water in an amount of 10 to 30% by weight, based on the weight of the coal powder.

3. A process as in claim 1 or 2, wherein the heating of coal granules separated by the screen is conducted by steam stripping.

4. A process as in claim 1 or 2, wherein the light fraction is selected from the group consisting of light naphtha, heavy naphtha, kerosine, straight-run gasoline, benzene, toluene xylene, and cyclohexane.

5. A process as in claim 1 or 2, wherein the heavy fraction is selected from the group consisting of vacuum gas oil, vacuum residue, atmospheric residuum, deasphalted oil, asphalt, and coal tar.

* * * * *